United States Patent [19]

Westberg et al.

[11] 4,449,964

[45] May 22, 1984

[54] DECANTING CENTRIFUGE

[75] Inventors: J. Eric H. Westberg, Lidingö; H. Peter O. Unger, Stockholm, both of Sweden

[73] Assignee: Separex Teknik AB, Stockholm, Sweden

[21] Appl. No.: 467,387

[22] Filed: Feb. 17, 1983

[51] Int. Cl.[3] ..... B04B 5/02

[52] U.S. Cl. ..... 494/16; 494/84

[58] Field of Search ....., ..... 494/16, 17, 18, 19, 494/20, 84, 85

[56] References Cited

U.S. PATENT DOCUMENTS

| | | | |
|---|---|---|---|
| 3,401,876 | 9/1968 | Lucas | 494/16 |
| 3,439,871 | 4/1969 | Unger | 494/16 |
| 4,193,536 | 3/1980 | Kubota | 494/20 |
| 4,285,463 | 8/1981 | Intengan | 494/20 |

*Primary Examiner*—Robert W. Jenkins

*Attorney, Agent, or Firm*—Hill, Van Santen, Steadman & Simpson

[57] ABSTRACT

A decanting centrifuge for processing liquid material in cylindrical open-topped sample tubes supported on the rotor and movable from a first position with the open ends directed towards the rotor axis and a second position for decanting supernatant from the sample tubes under the influence of the centrifugal force. In the second position the sample tubes are horizontal or include a relatively small angle with the horizontal, and the radially outermost generatrix of the inner surface of the sample tubes is tangent to an imaginary circular cylindrical surface concentric with the rotor, the tangent point being spaced by a predetermined distance from the closed bottom end of the sample tubes, so that a predetermined volume is retained between the tangent point and the bottom end.

10 Claims, 7 Drawing Figures

DECANTING CENTRIFUGE

BACKGROUND OF THE INVENTION

1. Field of the Invention:

This invention relates to decanting centrifuges for processing liquid material contained in sample tubes. More particularly, the invention relates to centrifuges for separating liquid material contained in sample tubes supported on a spinning rotor into a dense fraction and a supernatant fraction and then decanting the supernatant fraction from the sample tubes while the sample tubes are still being supported on the spinning rotor. (Proposed classification: 233-26).

2. Prior Art:

Centrifuges of the above kind are disclosed in, for example, GB Pat. No. 1,211,942, U.S. Pat. No. 3,401,876 and U.S. Pat. No. 4,285,463. They are commonly used for washing blood cells in connection with the so-called Coombs' test or similiar blood treating operations. Normally, several blood samples are treated simultaneously in different sample tubes supported on the centrifuge rotor.

Coombs' test requires that a sample consisting essentially of red blood cells be repeatedly washed in saline. Each washing cycle includes centrifugal separation of the contents of each sample tube into a denser blood cell fraction and a lighter or supernatant saline fraction containing material washed off from the red blood cells and decantation of the supernatant fraction from the sample tube.

During the separation step the sample tubes are oriented such that the open end or mouth of the sample tubes is substantially closer to the vertical axis of rotation of the rotor than is the opposite bottom end so that the blood cells are collected at the bottom end. In the prior art centrifuges the decantation is accomplished by raising the sample tubes from an inwardly and upwardly inclined position to a substantially vertical position, the supernatant fraction being discharged through the upwardly directed open end of the sample tubes under the influence of the centrifugal force while the blood cell fraction is retained.

During the decanting step it is required to discharge the supernatant fraction as completely as possible while avoiding loss of the red blood cells—which occupy a very small volume—with the decanted supernatant. This requirement is not met in a satisfactory manner in the prior art centrifuges.

SUMMARY OF THE INVENTION

The present invention provides a decanting centrifuge in which accurate decantation can be accomplished so that a precise volume of the contents of the sample tubes is retained after the decanting step is completed. To this end, the centrifuge rotor supports a sample tube holder adapted to hold at least one sample tube and being selectively movable between a first position wherein the open end of the sample tube is substantially closer to the rotor axis than is the opposite end and a second position for centrifugally decanting the supernatant fraction wherein the radially outermost generatrix of the inner surface of the sample tube is tangent at a point spaced from the bottom end of the sample tube to an imaginary circular cylindrical surface coaxial with the rotor and includes an angle with the plane containing the rotor axis and the tangent point.

This orientation of the sample tube in the decanting position means that a given volume will be retained in the sample tube, namely in a region adjacent to the bottom of the sample tube which is defined outwards by the inner surface of the sample tube and inwards by the imaginary cylindrical surface. By suitable selection of the position of the tangent point along the generatrix, the retained volume can be made to agree accurately with the volume it is desired to retain, that is, the volume of the washed blood cells. In accordance with the invention, the retained volume is concentrated to a small region near the bottom end, while in the prior art centrifuges it is spread out over the length of the sample tube.

To move the sample tube to the decanting position the centrifugal force can be utilized but it is preferred to accomplish this movement either by means of a control mechanism that is operable during rotation of the rotor and connected between the sample tube holder and an operating member or by means of an inertia-responsive mechanism.

In order that the invention may be more clearly understood, reference is made to the following detailed description of embodiments illustrated in the accompanying drawings.

DETAILED DESCRIPTION

Figure 1:
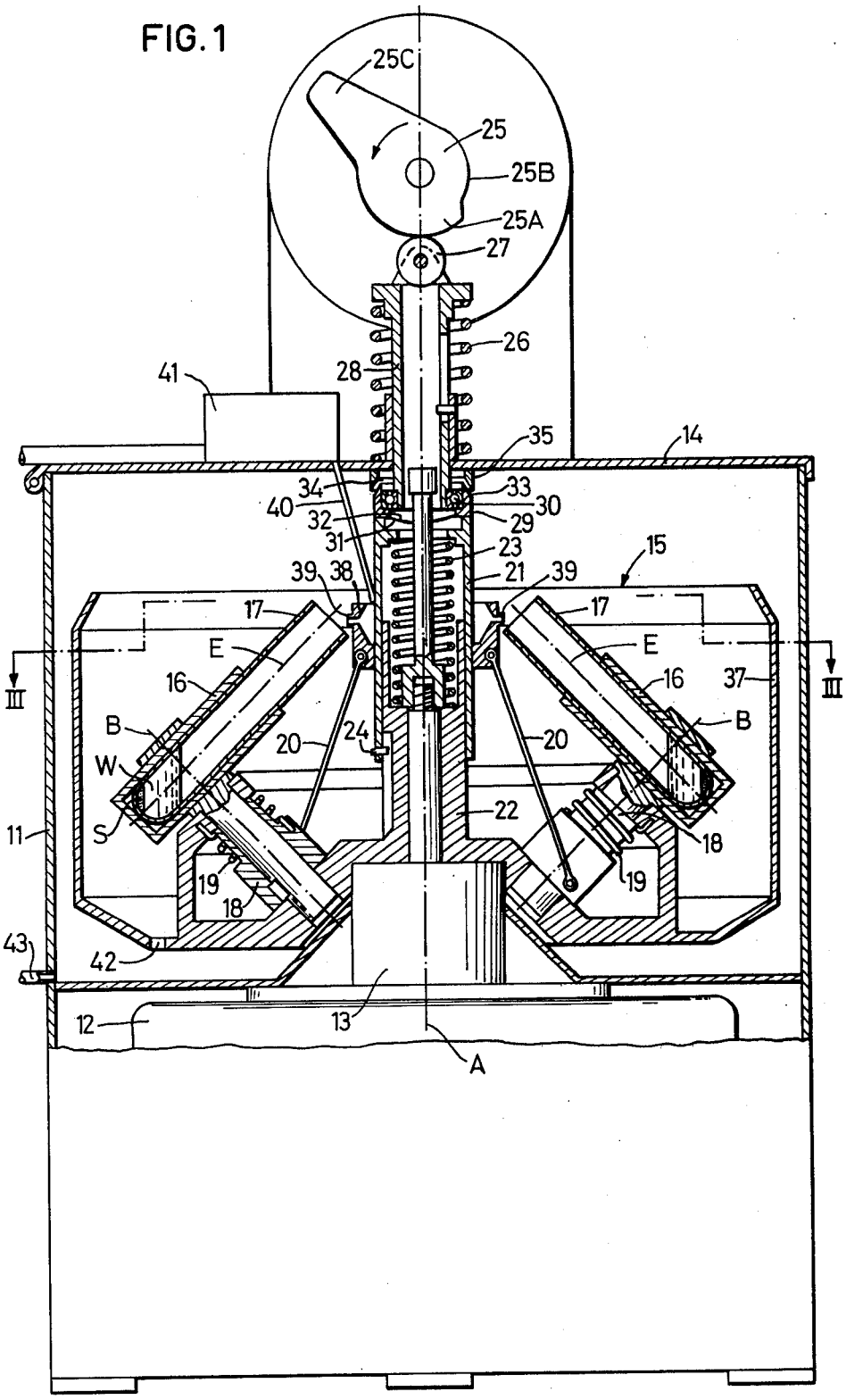
FIG. 1 is an elevational view, partly in axial cross section, of a first embodiment of a decanting centrifuge constructed in accordance with the invention, the sample tubes being shown in an inwardly and upwardly inclined position for separating the contents thereof into a denser fraction and a lighter or supernatant fraction.

As shown in FIG. 1, the centrifuge comprises a housing 11 the lower portion of which accommodates an electric motor 12 having a vertical shaft 13. The upper housing portion, which is equipped with a hinged cover 14, accommodates a bowl-shaped rotor 15 which is secured to the motor shaft 13. The motor rotates the rotor 15 about its vertical axis A at a variable speed of, for example, 3000 to 5000 rpm, and is associated with control means (not shown) for selectively varying the speed and braking the rotor.

Four cup-shaped or tubular sample tube holders 16 are mounted on the rotor 15 at a distance from the rotor axis A and with uniform circumferential spacing. Each sample tube holder accommodates a removable circular cylindrical sample tube 17 having a rounded bottom end engaging the bottom wall of the sample tube holder.

Figure 3:
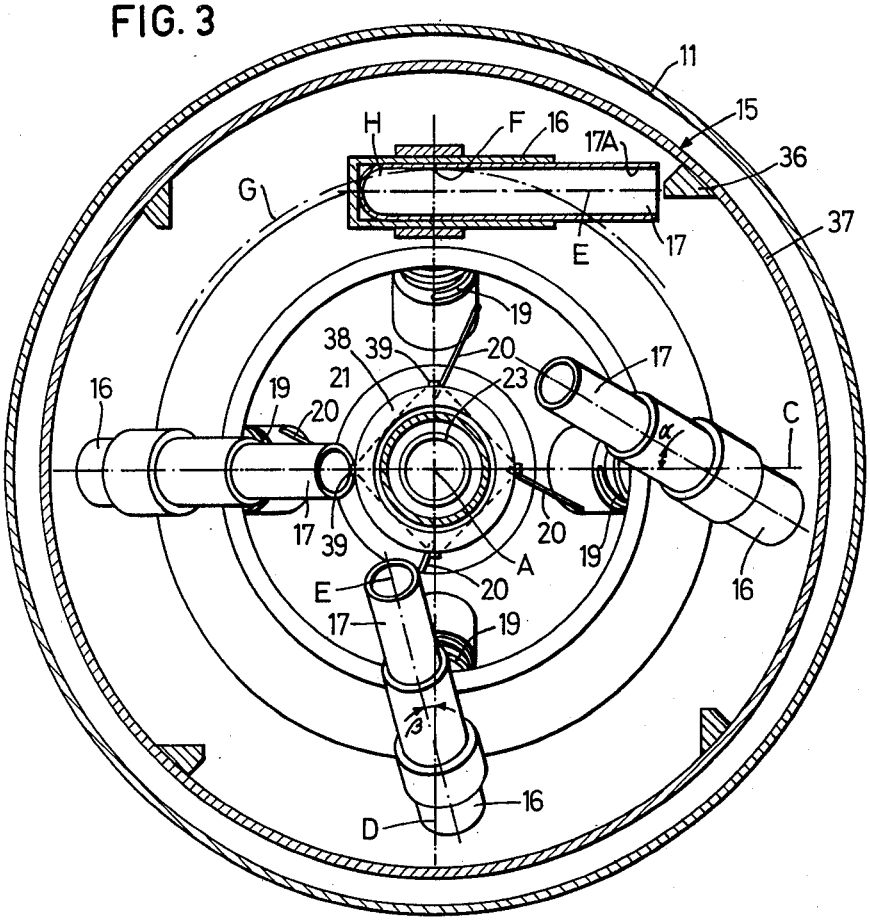
FIG. 3 is a plan view, partly in cross section, taken along line III—III of FIG. 1 but showing only one sample tube holder and sample tube in the position shown in FIG. 1, the remaining sample tube holders and sample tubes being shown in other positions.

Each sample tube holder 16 is secured to a shaft 18 the axis of which includes an angle of about 45° with the horizontal. The shafts 18 are rotatable mounted on the rotor 15, their axes B of rotation being located in pairs in two vertical orthogonal planes C, D containing the rotor axis A (FIG. 3). Moreover, each axis B is perpendicular to the axis E of the sample tube 17 held in the associated sample tube holder.

Figure 2:
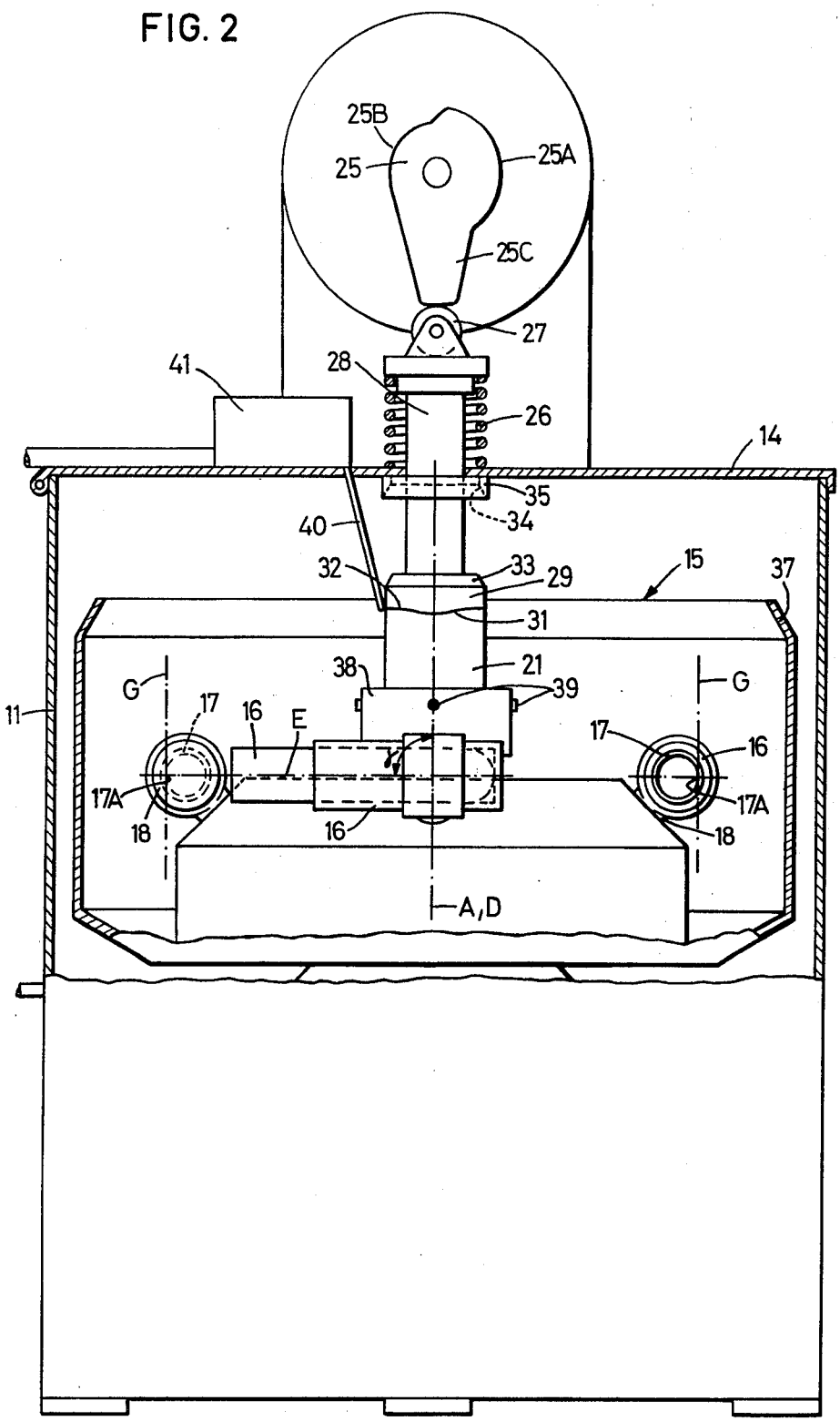
FIG. 2 is an elevational view generally similar to FIG. 1 but showing the decanting position.

Rotation of the shafts 18 will thus cause the sample tube holders 16 with the sample tubes 17 held therein to be rotated, namely, between a position wherein the sample tube axes E are inclined upwardly and inwardly as shown in FIG. 1 and a different position wherein the sample tube axes E are substantially horizontal as shown in FIG. 2. A control mechanism operable from outside the housing 11 both when the rotor rotates and is at rest is used to rotate the sample tube holders in unison. The control mechanism is described below.

A torsion spring 19 on each shaft 18 urges the associated sample tube holder 16 towards the second position, which is hereinafter referred to as the decanting position. A wire 20 is attached at one end to the circumference of each shaft 18 and is attached at the other end to an element secured to a collar 21 which is vertically displaceable on an upstanding central rotor hub 22 and rotates with the rotor 15. A compression spring 23 urges the collar 21 upwardly and is dimensioned to balance the combined forces applied to the collar by the torsion springs 19. The collar 21 thus tends to rotate the sample tube holders 16 against the action of the springs 19 to a position, hereinafter referred to as the loading position, wherein each sample tube axis E includes an angle $\alpha$ (FIG. 3) with the axial plane C, D containing the axis B of rotation of the associated sample tube holder shaft 18. As apparent from FIG. 3 wherein the loading position is shown to the right and the decanting position is shown at the top, the just-mentioned angle $\alpha$ and the angle $\gamma$ (see FIG. 2) included in the decanting position between the sample tube axis E and the axial plane C, E are on opposite sides of that plane. The sample tube holders are rotated to the loading position when the cover 14 is folded up to allow the spring 23 to displace the collar 21 to an upper position defined by an abutment 24. With the sample tube holders 16 in the loading position, the sample tubes 17 can conveniently be inserted in and removed from the sample tube holders.

Both when the rotor 15 is rotating and when it is at rest, the collar 21 can be displaced downwardly by means of a power-driven cam 25 located above the cover 14. The cam 25 acts on the collar through a vertical tubular pusher 28 urged towards the cam by a spring 26 and provided with a cam follower roller 27. The pusher 28 is non-rotatably guided in the housing and carries at its lower end a thrust ring 29 rotably journalled by means of ball bearing 30.

The lower end face 31 of the thrust ring 29 is undulated and engages the correspondingly undulated end face 32 of the collar 21. When the thrust ring 29 is pressed against the collar 21 by the pusher 28, the thrust ring is frictionally coupled to the collar and thus caused to rotate with it. Such pressing of the thrust ring against the collar is brought about when a portion 25A of the cam 25 maintains the pusher 28 in a slightly depressed position through the roller 27 as shown in FIG. 1. With the pusher 28 and, consequently, the thrust ring 29 in such depressed position the sample tube holders 16 are held in position, hereinafter referred to as the separation position, wherein the axis E of each sample tube 17 includes a small angle $\beta$ with the axial plane C, E, namely on the side of the plane opposite to the loading position (angle $\alpha$), i.e. on the same side as the decanting position. The separation position is shown in the lower portion of FIG. 3.

On its upper end face 33 the thrust ring 29 is provided with a conical friction surface. Under the influence of the ball bearing 30 the thrust ring is engageable with a mating conical friction surface 34 on a stationary brake ring 35 secured to the underside of the cover 14 to provide frictional coupling of the thrust ring to the brake ring. When the rotor 15 and, hence, the collar 21 are rotating, the collar 21 will then be oscillated vertically by the undulated end faces 31 and 32 so that the sample tube holders 16 with the sample tubes 17 are angularly oscillated at a corresponding rate about the axes B. Such angular oscillation, which takes place about a mean position wherein the tube axes E are contained in the axial planes C, E—see the illustration to the left in FIG. 3—serves to effect a thorough intermixing of the contents of the sample tubes 17. The engagement of the thrust ring 29 with the brake ring 35 is brought about when a portion 25B of the cam 25 takes a position facing the roller 27 but out of engagement with it.

To move the sample tube holders 16 with the sample tubes 17 to the decanting position, a projection 25C of cam 25 depresses the collar 21 through the pusher 28 and the thrust ring 29 so that the wires 20 allow the springs 19 to turn the sample tube holders with the sample tubes to a substantially horizontal position as shown in FIG. 2 and at the top of FIG. 3. In the decanting position, in which the angle $\gamma$ included between the axis E of each sample tube 17 and the axial plane C, D containing the axis B of the associated sample tube holder 16 thus is substantially 90°, the mouths of the sample tubes 17 are positioned in front of and adjacent to lugs 36 on the inner surface of a cylindrical rotor wall 37 so that the sample tubes are kept from leaving the sample tube holders 16 during the decanting step.

As shown in FIG. 3, in the decanting position the radially outermost generatrix 17A of the inner surface of each sample tube 17, i.e. the generatrix which is farthest away from the rotor axis A and which in the illustrated embodiment is horizontal or nearly horizontal, is tangent at a point F spaced from the bottom end of the sample tube to an imaginary circular cylindrical surface G the axis of which coincides with the vertical rotor axis A. Adjacent to the bottom end of the sample tube there is, therefore, a region H which is defined outwards by the inner surface of the sample tube and defined inwards by the cylindrical surface G and within which the magnitude of the centrifugal force is greater than at the tangent point F.

A distributor vessel 38 secured to the collar 21 is open at its upper end and provided with four spouts 39 situated in the axial planes C, E. The spouts 39 are level with the open top ends of the sample tubes 17 when these are in the mixing position shown to the left in FIG. 3 so that wash liquid can be introduced in the sample tubes under the influence of the centrifugal force. Measured amounts of wash liquid can be fed to the distributor vessel 38 through a dispensing tube 40 of a dispenser 41 supported on the cover 14. As shown in FIG. 1, the top end of the wires 20 are secured to the distributor vessel 38 so that the sample tube holders are rotated to the mixing position in response to closing of the cover 14.

When carrying out the cell washing cycles of Coombs' test the sample tubes 17 containing their respective samples, each consisting of a few droplets of a blood sample, are inserted in the sample tube holders 16. This is done with the rotor 15 at rest and with the cover 14 in the folded-up position so that the sample tube holders 16 are in the loading position shown to the right in FIG. 3.

After the cover 14 has been folded down and the pipetting dispensing device 41 has fed a measured volume, e.g. 10–20 $cm^3$, of wash liquid to the distributor vessel 38, the rotor 15 starts rotating with the cam portion 25B rotated to a position in which it is opposite to but not in engagement with the roller 27 so that the sample tube holders 16 with the sample tubes 17 are oscillated about the mean position shown to the left in FIG. 3. The amplitude of the oscillatory movement is relatively small so that the open top ends of the sample tubes are always in front of the spouts. Under the influence of the centrifugal force a predetermined volume (one-fourth of the volume fed by the dispenser) of wash liquid is introduced in each sample tube, and the rapid oscillation of the sample tubes brings about a thorough intermixing of the samples and the wash liquid. During the mixing step, the rotor is conveniently driven at a relatively low speed.

When the mixing step is completed, the cam 25 is rotated until the cam portion 25A engages the roller 27 to depress the pusher 26 and the thrust ring 29 and, accordingly, the collar 21 so that the sample tube holders 16 with the sample tubes 17 are moved to the separation position shown in FIG. 1 and in the lower portion of FIG. 3. The rotor 15 is then driven at full speed to divide the contents of the sample tubes into a denser blood cell fraction S and a lighter or supernatant liquid fraction W consisting essentially of wash liquid and washed-off material, see FIG. 1.

Upon completion of the separation step, the cam 25 is rotated further with the rotor still rotating, so that the cam projection 25C depresses the collar 21 until the sample tube holders 16 with the sample tubes 17 are in the decanting position shown in FIG. 2 and at the top of FIG. 3. The supernatant liquid fraction is then centrifugally thrown out of the sample tubes; it is collected by the rotating rotor wall 37 and later, when the rotor 15 is at rest, drained away through an outlet opening 42 in the bottom wall of the rotor and a drain conduit 43. Only the material confined in the region H (FIG. 3), that is, substantially only the blood cell fraction S, is retained in the sample tubes 17.

Following the decanting step the cam 25 is again rotated until the cam portion 25B is opposite to the roller 27 so that the sample holders are returned to the mixing position. In this position wash liquid is again introduced in the sample tubes as described above and mixed with the blood cells which have thus been washed once. The second washing cycle is then completed as described above whereupon at least one additional similar washing cycle is carried out. Following the decanting step terminating the last washing cycle the blood cells retained in the sample tubes are subjected to the remaining steps of Coombs' test.

The volume of the material retained in the sample tubes may be accurately adjusted by suitable choice of the sample tube dimensions and the location of the tangent point F relative to the bottom end of the sample tubes and can be kept within close limits. It should be noted that the volume of the retained material is not affected by the frequently occurring irregularities of the mouth portions of the sample tubes as is the case with the prior art centrifuges.

In a modified version (not shown) of the centrifuge shown in FIG. 1 to 3 the mixing step is performed not by angularly oscillating the sample holders but by rotating the sample tubes in their respective holders during rotation of the rotor. Such rotation of the sample tubes may be accomplished in the manner shown in U.S. Pat. No. 3,401,876. Preferably, however, each sample tube holder is associated with a friction roller supported on the rotor and driven by the motor used for rotating the rotor. In the mixing position the sample tubes are engaged by the friction rollers to be rotated about their axes E. With this system the sample tubes can be driven relatively slowly even when the rotor is rotated at high speed so that a very efficient mixing is achieved.

Although in the embodiment shown in FIGS. 1 to 3 the sample tubes are horizontal or nearly horizontal in the decanting position, a smaller angle $\gamma$ included between the axis E of each sample tube 17 and the plane C, D may be desirable. For example, if more than four sample tube holders are provided, the angle may be chosen such that in the decanting position the top or mouth portion of each sample tube overlies the adjacent sample holder. However, in order that the retention region H may not be unduly extended longitudinally of the sample tube, the angle $\gamma$ should be as large as possible and in any case it should never be smaller than about 45°.

FIGS. 4 to 7 show a second embodiment in which inertia-responsive means are used to effect movement of the sample tube holders and sample tubes held therein between a position for loading and separation and a position for decanting the supernatant liquid from the sample tubes. In this embodiment each sample tube holder may hold one or a plurality of sample tubes, the maximum number of sample tubes held in each sample tube holder being three in the illustrated case.

The centrifuge shown in FIGS. 4 to 7 comprises a housing 51 generally similar to the housing shown in FIGS. 1 to 3 and accommodates in the lower portion thereof an electric motor 52 associated with control means (not shown) for selectively changing the speed and braking a vertical output shaft 53. A hinged cover 54 provides access to a bowl-shaped rotor 55 fixedly secured to the shaft of the motor to rotate about a vertical rotor axis A.

Figure 4:
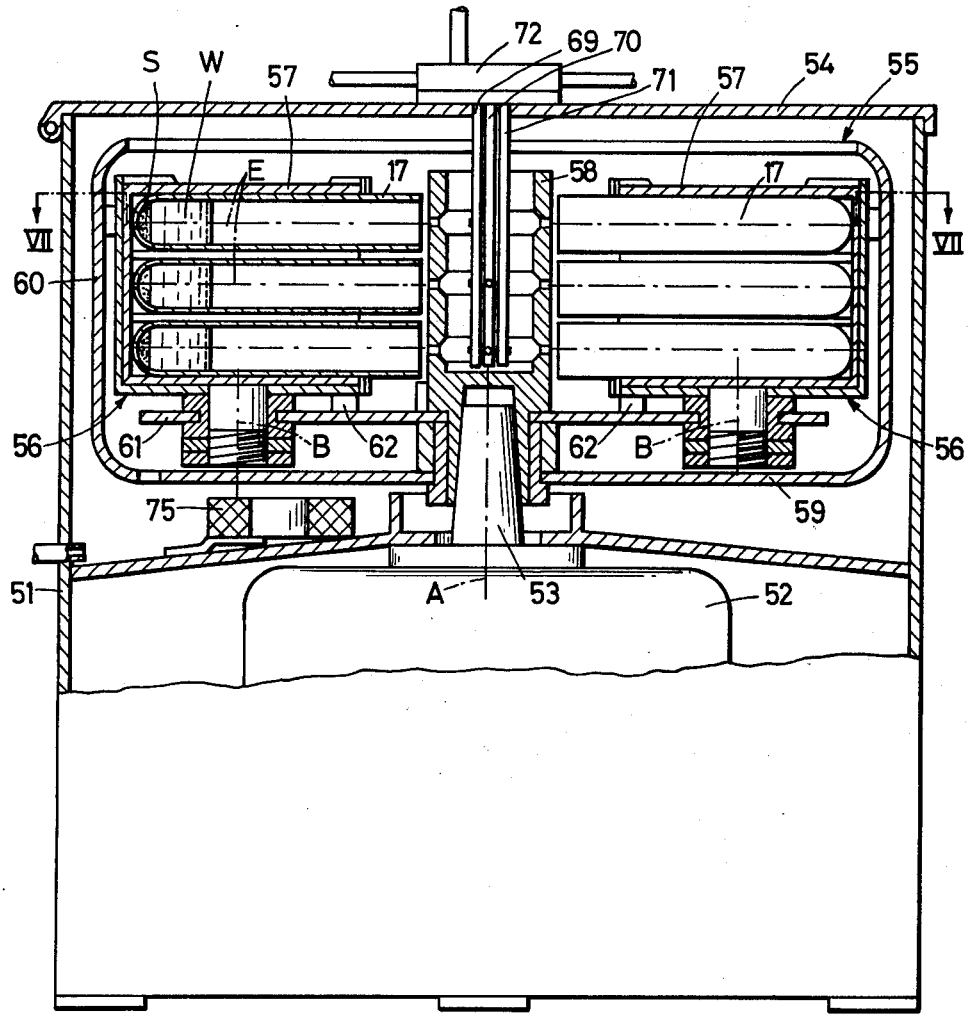
FIGS. 4 and 6 are views generally corresponding to FIGS. 1 to 3 of a second embodiment.
Figure 5:
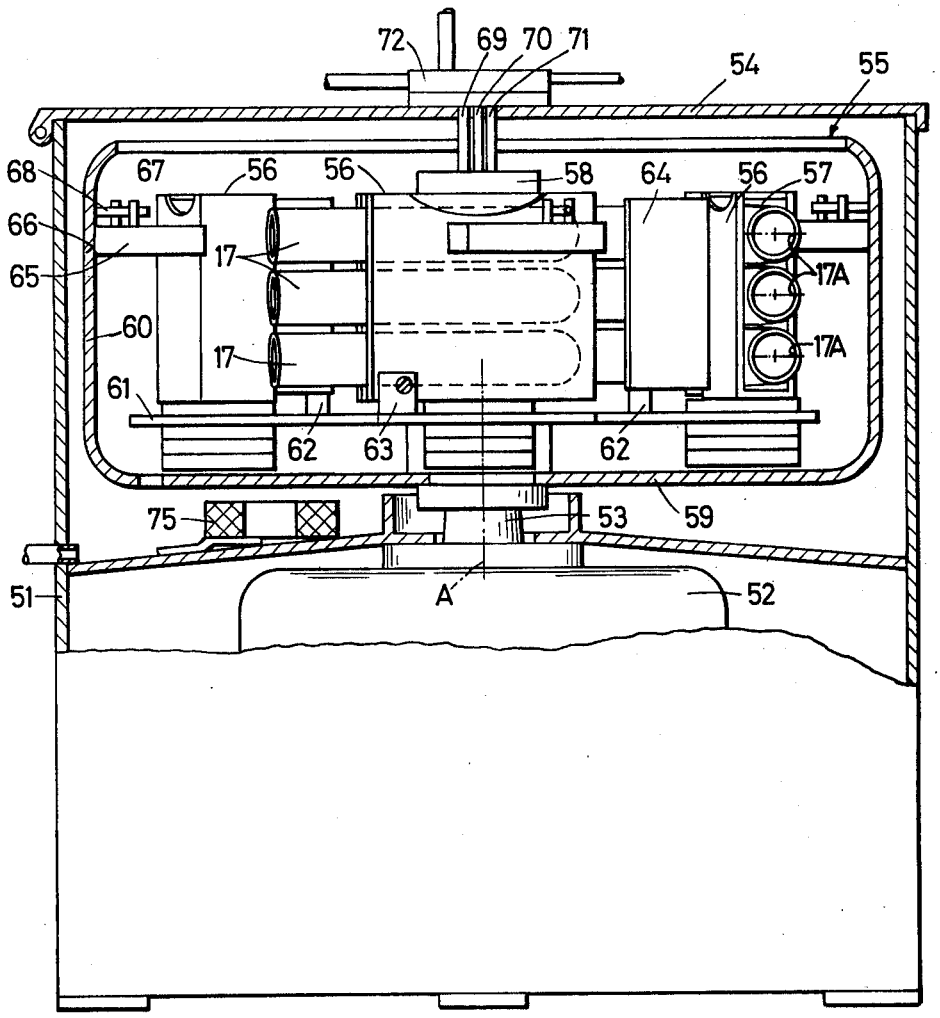

Four sample tube holders 56 are mounted within the rotor 55 at a distance from the rotor axis A and with uniform circumferential spacing. Each sample tube holder accommodates a box-shaped cartridge 57 in which three sample tubes 17 are held in slightly spaced-apart parallel relation with their mouths and bottom ends vertically aligned as best shown in FIG. 4. As best shown to the right in FIG. 5 and in FIG. 7 the horizontal and parallel axes E of the sample tubes are contained in a common vertical plane.

Centrally disposed in the rotor 55 is a tubular distributor vessel 58 (described in greater detail hereinafter) which is fixedly secured to the motor shaft 53. Supported on the lower portion of the distributor vessel 58 for rotational movement about the rotor axis A relative to the motor shaft is the rotor bowl 55 which is a relatively lightweight structure having a flat bottom wall 59 and a circumferential wall 60. The rotation of the rotor bowl relative to the motor shaft and components fixedly secured thereto is limited in a manner described below.

Fixedly secured to the lower portion of the distributor vessel 58 is a flat horizontal cruciform support plate 61. Each of the four arms of the support plate 61 supports one of the sample tube holders 56 for limited rotation relative to the support plate about a vertical axis B contained in the common vertical plane of the axes E of the sample tubes 17 held by the sample tube holder.

Figure 6:
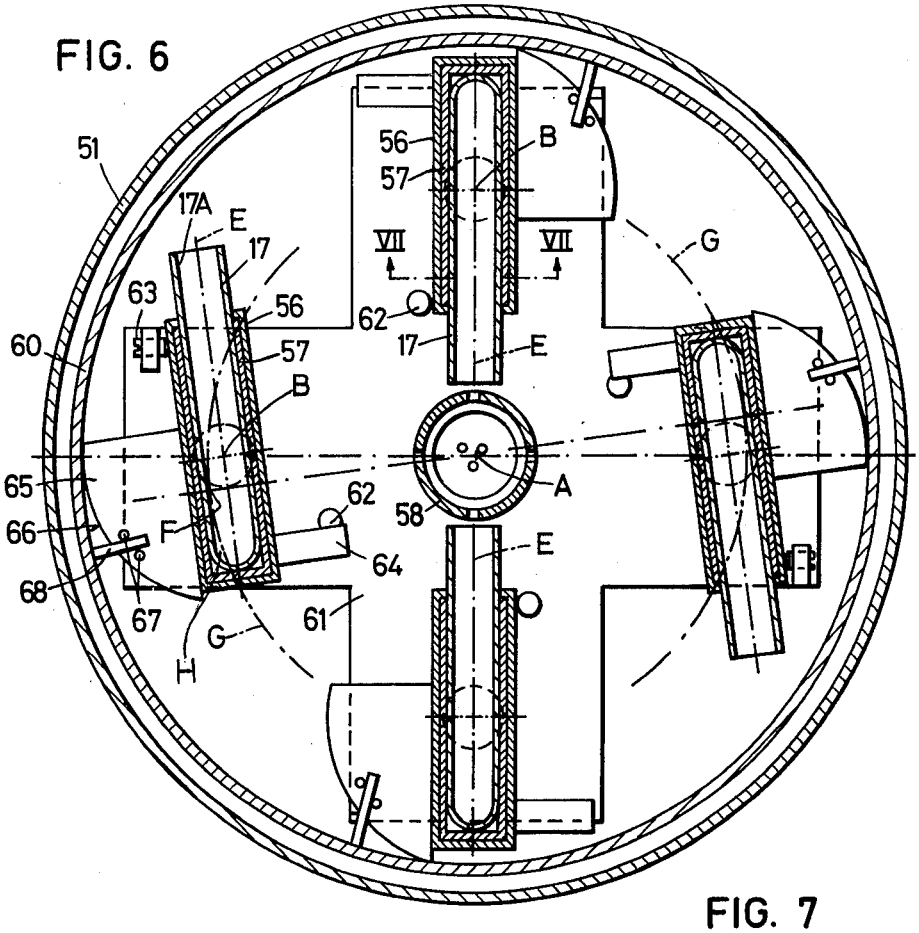

As best shown in FIG. 6 the rotational movement of each sample tube holder 56 about its vertical axis B is limited in one direction by a fixed abutment 62 on the support plate 61 engageable by a vertical sidewall of the sample tube holder and in the opposite direction by an adjustable abutment 64 engageable by the opposite vertical sidewall of the sample tube holder.

The position defined by the fixed abutment 62 is shown for the two sample tube holders at the top and bottom of FIG. 6 and is hereinafter referred to as the separation position. In this position the axes E of the sample tubes 17 are radial, i.e., contained in a plane containing the rotor axis A. A weighting body 64 secured to each sample tube holder serves to hold the sample tube holder in engagement with the abutment 62 under the influence of the centrifugal force.

To the left and right, FIG. 6 shows the sample tube holders 56 in the position defined by the adjustable abutment 63, hereinafter referred to as the decanting position. With the illustrated setting of the abutment 63, the angle included between the two positions is slightly greater than 90° but depending on the volume it is desired to retain in the sample tubes upon the decantation, the angle may be varied into the range below 90°.

As also shown in FIG. 6, in the decanting position that generatrix 17A of the inner surface of each sample tube 17 which is farthest from the rotor axis A is tangent to an imaginary circular cylindrical surface G, the axis of which coincides with the rotor axis A, the tangent point F being spaced from the bottom end of the sample tube. This, as already described with reference to FIGS. 1 to 3, in the decanting position there is a region H near the bottom end of each sample tube which is defined by the inner surface of the sample tube and the cylindrical surface G and in which a portion of the contents is retained.

Secured to the top portion of each sample tube holder 56 is a flat horizontal backing plate 65 having an arcuate outer edge 66 centered on the axis B of rotation of the sample tube holder. Regardless of the angular position of the sample tube holder, the outer edge 66 is very close to the inner surface of the circumferential rotor wall 60. Thus, as the centrifugal force tends to throw the upper portion of the sample tube holder radially outwardly, the backing plate 65 will produce a radial reaction force to prevent unwanted outward displacement of the sample tube holders.

A pair of horizontally spaced vertical pins 67 is secured to each backing plate 65 adjacent to the arcuate outer edge 66. For each plate 65, a horizontal pin 68 secured to the inner surface of the circumferential rotor wall 60 is received between the vertical pins 67 and serves to bring about rotational movement of the associated sample tube holder in response to relative rotational motion about the rotor axis A of the circumferential rotor wall 60 and the support plate 61 carrying the sample tube holders 56.

As shown in FIG. 4, the tubular distributor vessel 58 is provided with three vertically spaced internal circumferential grooves, each on a level with one sample tune 17 in each of the four sample tube holders. Each such groove communicates with four outlet openings adapted to discharge wash liquid from the groove into respective ones of the four sample tubes when the latter are in the separation position. Depending on the number of sample tubes 17 present in each sample tube holder, wash liquid (saline) is fed to a selected one of three distributor tubes 69, 70, 71 projecting into the distributor vessel. The distributor tubes are also used for supplying rinsing water and serum. A valve 72 mounted on the cover controls the supply and removal of the liquids.

Figure 7:
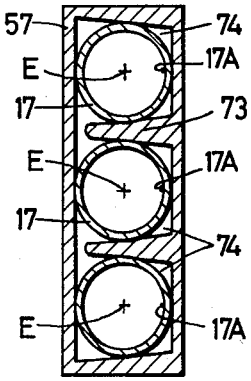
FIG. 7 is a cross-sectional view taken along line VII—VII of FIG. 6 of a sample tube cartridge containing three sample tubes.

FIG. 7 shows the cross-sectional shape of the cartridge 57. The sample tubes 17 are frictionally held in position in the cartridge by external walls and partitions 73 defining three elongated pockets 74 having a tapering cross-section. The cartridges 57 are oriented in the sample tube holders 56 such that wedging action of the side walls of the pockets tends to increase the frictional holding force on the sample tubes in the decanting position when the centrifugal force acts generally transversely on the sample tubes.

Briefly, the cell washing cycles of Coombs' test are carried out as follows.

After the samples to be tested have been inserted in the test tubes 17 in their cartridges 57, the cartridges are placed in the sample tube holders 56 as shown in FIG. 4. Only very small amounts of samples are used so that the samples are kept in the sample tubes even though the sample tubes are horizontal and the rotor is initially at rest.

With the sample tube cartridges 57 supported on the sample tube holders 56, the rotor 55 is set in motion and is initially rotated at a relatively low speed. If the sample tube holders 56 are not already in the position shown in FIG. 4 and at the top and bottom of FIG. 6, i.e., the separation position, they will be moved to that position as soon as the motor shaft 53 and, hence, the support plate 61 with the sample tube holders start rotating, because the rotor bowl 59, 60 will tend to lag behind the support plate.

Assuming that each cartridge contains three sample tubes 17, a predetermined volume of wash liquid will be supplied from a dispensing device (not shown) through the valve device 72 and the distributor tube 69 (provided with three vertically spaced outlets) such that one-third of that volume is fed to each circumferential groove and distributed in equal volumes to the sample tubes.

When the sample tubes have received the wash liquid, the speed of the rotor 55 is gradually increased up to and through the resonant speed. At the same time, a stationary solenoid 75 mounted in the housing 51 immediately below the rotor 55 is energized to subject magnetizable material of the sample tube holders to an eccentrically acting varying force. This force in conjunction with the vibrations resulting from the passage through the critical speed will result in a thorough intermixing of the sample and the wash liquid.

Following running of the rotor 55 at high speed for a predetermined time and the consequent separation of the contents of each sample tube 17 into a blood cell fraction S and a supernatant or wash liquid fraction W, the speed of the rotor is reduced by braking. Because of the inertia, the rotor bowl 59, 60 tends to rotate relative to the support plate 61 to move the sample tube holders to the decanting position. However, the frictional coupling of the rotor bowl to the support plate through the backing plates 65 and the sample tube holders 56 as well as the centrifugal force acting on the weighting elements 64 prevents such relative rotation until the rotor speed has decreased substantially. When finally the relative rotation becomes possible and the sample tube holders are moved to the decanting position, the supernatant fraction W is thrown out of the sample tubes 17 while the blood cell fraction S is retained in the region H.

The rotor speed is then again increased so that the sample tube holders are moved back to the separation position, and a further quantity of wash liquid is introduced in each sample tube as an initial step of the next washing cycle.

After a sufficient number of washing cycles have been carried out, Coombs' serum may be introduced in the sample tubes in the same manner as the wash liquid. After centrifugation at a relatively low speed, the cartridges are removed from the sample tube holders for visual inspection of the samples through openings (not shown) in the cartridge walls.

Naturally, several modifications of the centrifuge shown in FIGS. 4 to 7 can be made without departing from the scope of the invention. For example, if it is desired to utilize the so-called angle effect for the separation into fractions of the contents of the sample tubes, or if it is desired to be able to hold larger quantities of liquid in the sample tubes when the centrifuge rotor is at rest, the sample tube cartridges or the sample tube holders or both can be modified so that the sample tubes are inclined upwardly and inwardly in the separation position. Moreover, a control mechanism operable from outside the centrifuge rotor may be provided in place of the illustrated inertia-responsive control mechanism to effect rotation of the sample tube holders between the separation position and the decanting position by positively acting means. The agitation of the material in the sample tubes may also be effected in other ways and using other means than those described. For example, the agitation may be commenced before the wash liquid is added.

What we claim is:

1. A decanting centrifuge, comprising a motor, a rotor having a vertical axis and drivingly connected with the motor for rotation about said axis, at least one sample tube holder supported eccentrically on the rotor for rotation therewith and adapted to hold at least one generally cylindrical sample tube having an open end and adapted to contain liquid material, the sample tube holder being rotable with respect to the rotor and means for selectively moving the sample tube holder and a sample tube held thereby between a first position wherein the open end of the sample tube is substantially closer to the rotor axis than is the opposite end, and a second position for centrifugally decanting a portion of the liquid sample from the sample tube the generatrix of the inner surface of the sample tube which is farthest from the rotor axis being tangent at a point spaced from said opposite end of the sample tube to an imaginary circular cylindrical surface coaxial with the rotor and having an angle with the plane containing said rotor axis and said tangent point.

2. A centrifuge as claimed in claim 1, said angle being at least 45°.

3. A centrifuge as claimed in claim 1, said sample tube holder being mounted for a limited rotational movement relative to said rotor about an axis which is substantially perpendicular to the axis of the sample tube.

4. A centrifuge as claimed in claim 1, said sample tube holder being connected through a force-transmitting mechanism with a tube-holder operating device actuatable exteriorly of said rotor.

5. A centrifuge as claimed in claim 4, said tube holder operating device being actuatable during rotation of said rotor.

6. A centrifuge as claimed in claim 1, said sample tube holder being mounted for limited rotational movement relative to said rotor about an axis contained in a plane containing said rotor axis.

7. A centrifuge as claimed in claim 1 in which in said second position, said sample tube, being substantially horizontal.

8. A centrifuge as claimed in claim 1, said rotor includes inertia-responsive means for moving said sample tube holder between the first and second positions, said inertia- responsive means comprising a sample tube holder support, an operating member mounted for rotational movement about the rotor axis relative to said sample tube holder support, and means operatively coupling said operating member with said sample tube holder and responsive to relative rotational movement of the operating member and the sample tube holder support.

9. A centrifuge as claimed in claim 8, said sample tube holder being mounted for rotational movement on a support plate and having back-up means engageable with said operating member at a location vertically spaced from said support plate for supporting the sample tube holder against movement away from the rotor axis.

10. A centrifuge as claimed in claim 1, said sample tube holder releasably supporting a sample tube cartridge comprising means for accommodating a group of sample tubes and for holding them in spaced parallel relation.

* * * * *